United States Patent [19]

Trick et al.

[11] Patent Number: 4,760,763

[45] Date of Patent: Aug. 2, 1988

[54] SELF-GRIPPING CAP REMOVER FOR CHILD RESISTANT MEDICATION CONTAINERS

[76] Inventors: O. Lee Trick, 10002 Green Tree, Houston, Tex. 77042; Royel F. Montieth, 3615 Cobleskill La., Missouri City, Tex. 77459

[21] Appl. No.: 929,604

[22] Filed: Nov. 12, 1986

[51] Int. Cl.[4] ..... B67B 7/44

[52] U.S. Cl. ..... 81/3.09; 81/3.4

[58] Field of Search ..... 81/3.4, 3.09; D8/40, D8/33, 43, 18

[56] References Cited

U.S. PATENT DOCUMENTS

| | | | |
|---|---|---|---|
| 1,960,531 | 5/1934 | Driscoll | 81/3.4 |
| 2,246,649 | 6/1941 | West | 81/3.4 |
| 2,519,447 | 8/1950 | Ensminger | 81/3.4 |
| 2,985,044 | 5/1961 | Gill | 81/3.4 |
| 3,038,178 | 6/1962 | Schumacher | 81/3.4 |
| 3,604,290 | 9/1971 | Waite | 81/3.4 |
| 3,812,741 | 5/1974 | Heine | 81/3.4 |
| 4,001,904 | 1/1977 | Gill | 81/3.4 |
| 4,337,678 | 7/1982 | Mumford | 81/3.4 |
| 4,433,597 | 2/1984 | Rowland | 81/3.09 |
| 4,702,129 | 10/1987 | Allen | 81/3.09 |

FOREIGN PATENT DOCUMENTS

| | | | |
|---|---|---|---|
| 2719440 | 11/1978 | Fed. Rep. of Germany | 81/3.4 |

*Primary Examiner*—Roscoe V. Parker

*Attorney, Agent, or Firm*—Russell J. Egan

[57] ABSTRACT

A tool for removing child resistant caps from medicine containers is formed of a resilient material providing a good frictional interfit with the cap to be removed. The tool has a lower surface defining a cap receiving recess and an upper surface defining a smooth surface of transition comfortably received in the palm of one's hand. The cap is removed by inserting it into the recess and by palm pressure only, depressing and rotating the cap to remove it from its child resistant engagement with the container.

9 Claims, 3 Drawing Sheets

SELF-GRIPPING CAP REMOVER FOR CHILD RESISTANT MEDICATION CONTAINERS

BACKGROUND OF THE INVENTION

1. Field of the Invention

The present invention relates to a device to remove a child resistant cap from a medication container without requiring gripping of the cap with the fingers and, in particular, to a device which will remove a child resistant cap using rotary action applied through the palm of the hand only.

2. The Prior Art

The consumer protection movement, which started in the United States in the 1960s, had many facets including one directed toward protecting children from ingesting medications and harmful substances. Requirements were enacted that manufacturers and dispensers of certain goods place them in containers which could be opened only with a degree of manual dexterity which was assumed to exceed that of most children. The basic designs which were realized to accomplish the child resistant status were generally in two forms. In one form, the container was provided with a series of bayonnet like slots and the cap with projections which interfit in the slots. For application or removal of the cap, it was required to both depress the cap and to rotate it in order to free it from the bayonnet like slot. The other form involved a somewhat similar arrangement except that the cap was in a two-piece arrangement in which the outer cap had to be squeezed against the inner cap in order to transmit a rotary force allowing the inner cap to be unthreaded from the container. Examples of some of these child resistant caps can be found in U.S. Pat. Nos. 3,115,979; 3,371,808; 3,450,289 and 4,020,965.

While these approaches have had a certain degree of success in limiting access to containers by children, they have also had the side effect disadvantage of hampering adults who have diminished manual dexterity and have need to open the containers to get their necessary medicine. For example, peopel with arthritis, neurological disease, muscular atrophy or diminished manual dexterity from any cause have all experienced various degrees of difficulty and frustration in removing the child resistant caps from their medication containers. Some of the known devices which offer to ease the removing of such lids or caps from containers have done so by providing increased friction to aid in the rotational movement required for removal of the cap. These devices still require a squeezing force which must be supplied by the individual. Two examples of this type device can be found in U.S. Pat. Nos. 2,985,044 and 4,001,904. Both of these devices are made out of resilient flexible plastic material and are profiled to increase the relative frictional forces. These devices, however, require the application of a squeezing force which is difficult for the individual with decreased manual dexterity or digital disability. There are other devices which are in the line of a wrench and require radial squeezing to grippingly engage the cap to be removed. Examples may be found in U.S. Pat. Nos. 2,246,649; 2,519,447 and 3,812,741. Other devices are more aplicable to removing crown caps by prying them off. Examples of these may be found in U.S. Pat. Nos. 3,038,178; 4,337,678 and 4,433,597.

The present invention overcomes the difficulties of the prior art by providing a device which does not require any finger gripping action and in which the force for removal of the cap is applied by the palm of the user's hand. In effect, the present invention translates a downward and rotational movement with the palm of the hand to the necessary gripping force to remove a child resistant cap from a container.

SUMMARY OF THE INVENTION

The present invention is a device for removing child resistant medication container caps and is an integral member formed of a resilient material having a curved top surface, a planar bottom surface and at least one cap receiving recess in the bottom surface. The device is used by inserting the cap to be removed into the recess and applying a downwardly and rotationally directed force with the palm of the hand on the curved top surface. The device provides enough frictional engagement to transfer this movement to the child resistant cap to effect its removal.

The subject device can have a stepped cap receiving recess in order to provide the capability of removing caps of more than one size.

The subject device can also be provided with both ribs on the curved top surface for improved gripping with the palm as well as inwardly directed profiling to increase the frictional engagement between the tool and the child resistant cap being removed. The inwardly directed profiling can include peripheral fluting or suction cup type projections. Increased frictional engagement can also be accomplished by use of an insert of soft silicon rubber.

BRIEF DESCRIPTION OF THE DRAWINGS

The present invention will now be described by way of example with reference to the accompanying drawings in which.

DETAILED DESCRIPTION OF THE PREFERRED EMBODIMENT

Figure 1:
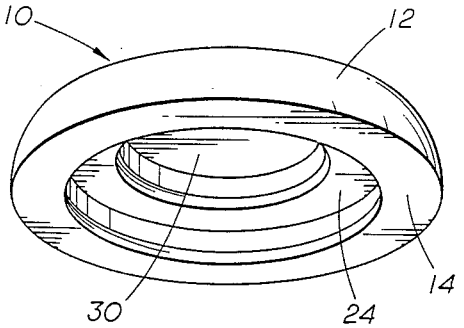
FIG. 1 is a bottom perspective view of the subject invention.
Figure 2:
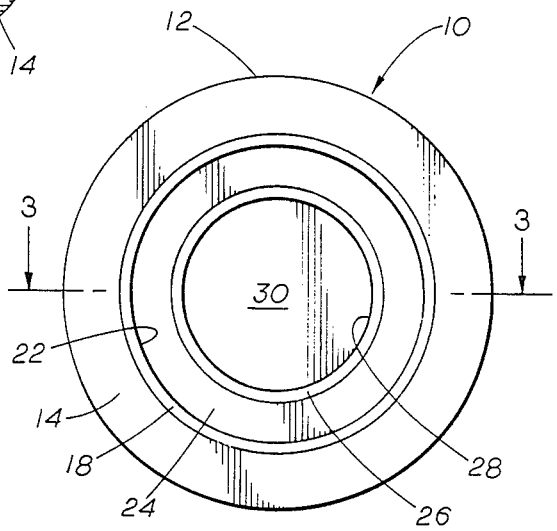
FIG. 2 is a top plan view of the subject invention.
Figure 3:
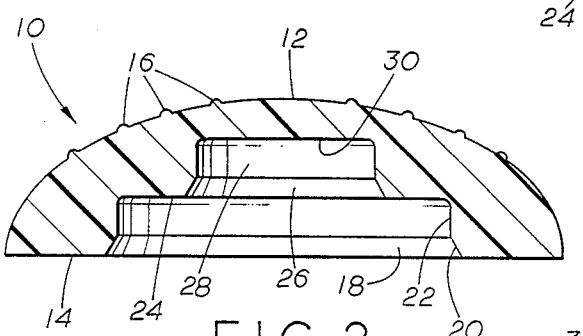
FIG. 3 is a transverse vertical section taken along line 3—3 of FIG. 2.

The present invention will be described primarily with reference to FIGS. 1–3. The subject tool 10 is shown with sort of a "flying saucer" shape combining a curved top surface 12 and a planar bottom surface 14. The top surface can be a smooth surface of transition or can be provided with a plurality of annular ribs 16, best seen in FIGS. 2 and 3, to increase frictional gripping. Other profilings or surface treatments (not shown) could likewise be formed on the top surface to increase frictional contact with the user's palm. The bottom surface 14 has a recess 18, which in this case is a stepped recess formed by a first truncated conical entry portion 20, a first cylindrical portion 22, an annular shoulder 24, a second truncated conical entry 26, a second cylindrical portion 28 and a second abutment shoulder 30. The second cylindrical portion 28 is clearly smaller in diameter than the first cylindrical portion 22, but both are approximately the same depth, that is about equal to the height of a cap.

The subject invention is preferably molded as a single piece of flexible resilient material of sufficient hardness to withstand repeated uses without decomposition or erosion of the gripping surface. Such materials are readily available and can be selected both for their tactile sensation as well as their natural appearance. Since those for whom the invention is primarily intended are of diminished physical ability, bright or highly noticeable colors are preferred.

Figure 4:
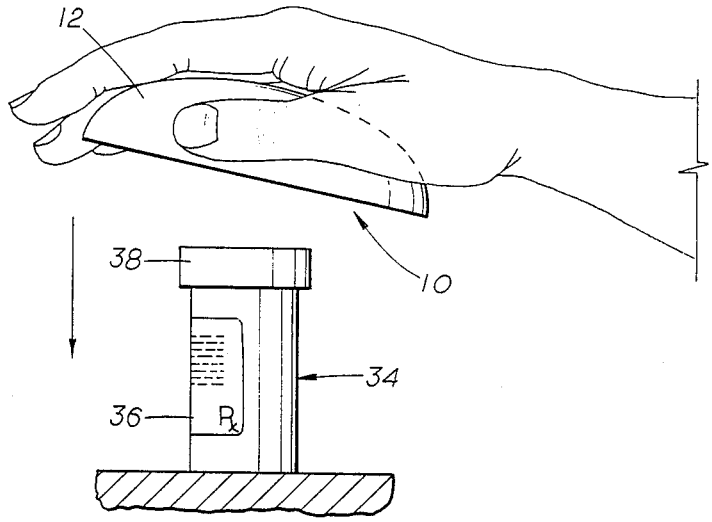
FIGS. 4, 5 and 6 are side elevations, partly in section, showing the steps in utilizing the subject device to remove a child resistant cap from a medication container.
Figure 5:
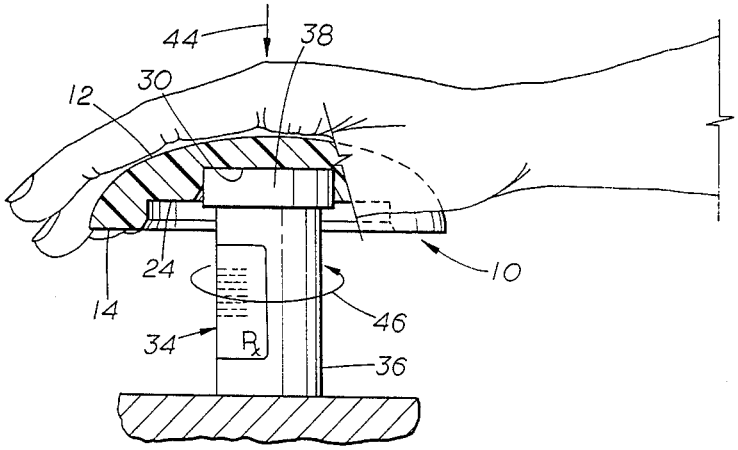
Figure 6:
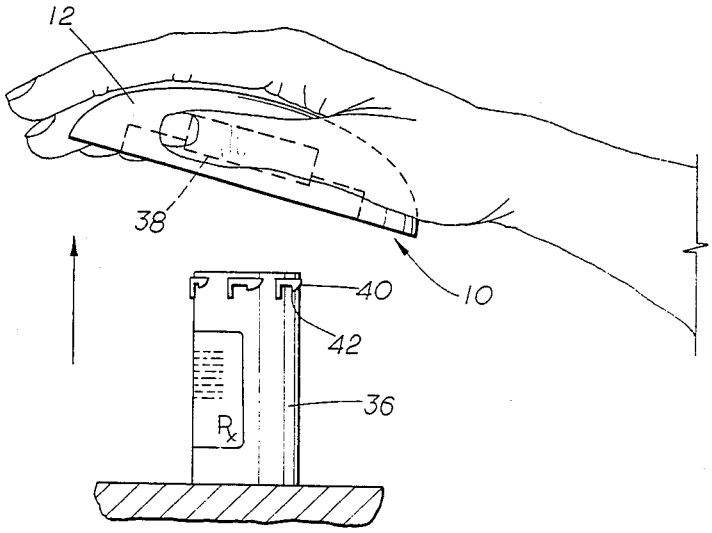

The present invention is utilized as shown in FIGS. 4–6. The medication container 34 is of known configuration, as represented by any of the previously mentioned patents, and has a body 36 with a child resistant cap 38 mounted thereon and held in place by gripping means 40 including detents 42 which receive studs (not shown) carried inwardly directed by the cap 38. The container 34 is placed on a solid surface, or in one hand, and the subject tool 10 is held in the palm of the user's hand, as shown in FIG. 4. The tool is then brought into engagement with the cap which is received in the appropriately sized portion of the stepped recess 18. A continued downward force, as noted by the arrow 44, and a rotational force, as noted by arrow 46, serve to depress and rotate the cap 38 with respect to the container 36 and allow it to be lifted off, as shown in FIG. 6. It should be pointed out that the subject tool does not require gripping with the fingers in order to remove the cap from the container.

Figure 7:
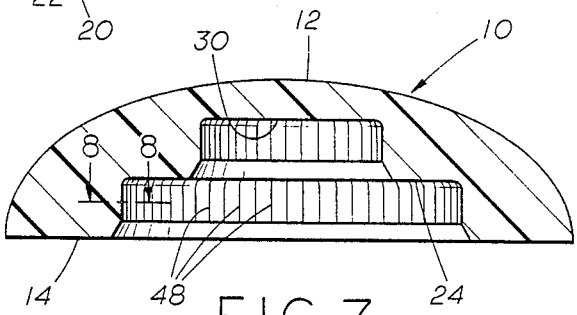
FIG. 7 is a transverse vertical section showing an alternate embodiment of the present invention.
Figure 8:
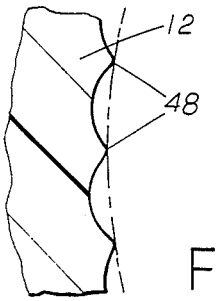
FIG. 8 is a transverse section taken along line 8—8 of FIG. 7 showing the fluting in the side walls in detail.

A first alternate embodiment of the present invention is shown in FIGS. 7 and 8. In this embodiment, the inner walls of the first and second cylindrical portions are provided with a series of parallel spaced flutes 48 best seen in detail in FIG. 8. It is not intended that these flutes be so sized and spaced as to engage in the rather shallow flutes that are found on some medication container caps. The purpose is not to create a one-to-one flute engagement in the manner of previously mentioned U.S. Pat. No. 3,812,741, but merely to increase the frictional contact which can be achieved between the subject tool and the side walls of a cap.

Figure 9:
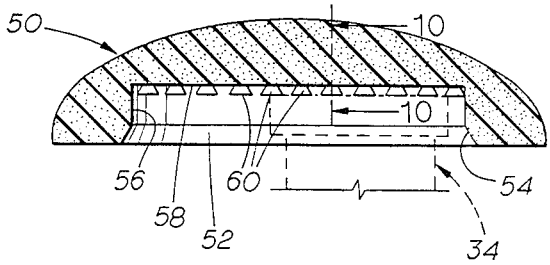
FIG. 9 is a transverse vertical section through a further alternate embodiment of the subject invention.
Figure 10:
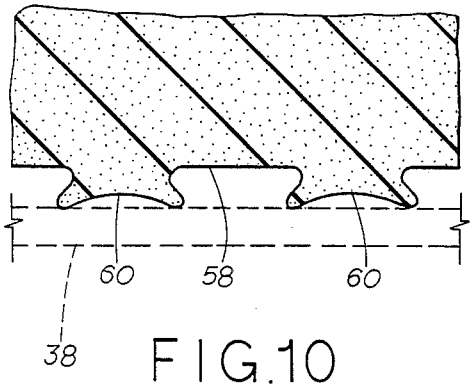
FIG. 10 is a detailed section taken along line 10—10 of FIG. 9.

FIGS. 9 and 10 show a second alternate embodiment of the present invention. In this instance, the device 50 has a single, large cavity 52 defined by a truncated conical entry portion 54, a cylindrical portion 56, an abutment surface 58 and a plurality of suction cup like projections 60 formed on the surface 58. The top surface can have any of the previously mentioned treatments.

It will be readily appreciated that the suction cup projections 60 in this embodiment are intended to provide an increased frictional contact with the cap to be removed. It should also be appreciated that, since there is a single large cavity 52 in this embodiment, it is unlikely that the peripheral walls of a container cap will be completely engaged. However, the suction cup projections 60 will provide sufficient gripping with a cap that even an off-centered container (as shown in phantom in FIG. 9) can have its cap removed simply by providing a rotational force substantially coaxial with the elongated axis of the container.

Figure 11:
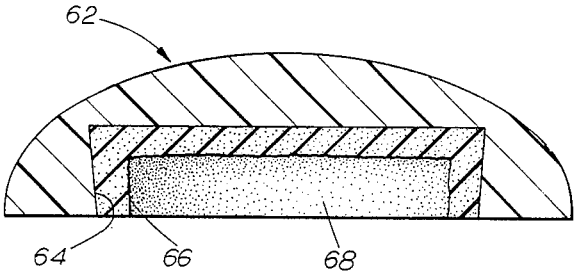
FIG. 11 is a transverse vertical section through a further alternate embodiment of the present invention.

FIG. 11 shows yet another alternate embodiment of the present invention. In this embodiment, the device 62 has an enlarged cavity 64 in which an insert 66 is placed, with the insert 66 defining a central cavity 68. In this embodiment, the body 62 is made of a harder material and the insert 66 is made of a soft silicon rubber to provide for a high friction cap engaging surface. It will be appreciated that the resiliency of the insert will provide flexibility for a tighter engagement of the cap. The insert could be stepped, as the preferred embodiment, or could be used in the offset manner of the second alternate embodiment.

All of the embodiments have been shown as they would appear if molded from a plastic or rubber material. The present invention could also be formed by other techniques, such as lamination.

The foregoig disclosure and description of the invention is illustrative and explanatory thereof, and various changes in the size, shape and materials as well as in the details of the illustrated construction may be made within the scope of the appended claims without departing from the spirit of the invention.

What is claimed is:

1. A hand tool for removing a closure of a child resistant type from a container neck, said closure having the profile of a short cylinder with inwardly directed container engaging means and requiring both downward and rotary action for removal, said tool comprising:

a body of resilient material having a three dimensionally curved upper surface of transition and an oppositely directed planar lower surface having therein at least one recess adapted to recieve said closure therein, a high friction profiled surface on at least an inner end wall of said recess whereby with a closure recieved in said cavity, downward and rotational pressure applied by the palm of the hand on said top surface without the requirement of finger gripping action or finger pressure exertion will cause the release and removal of said child resistant closure by said tool.

2. The tool according to claim 1 wherein said recess is formed with a series of concentric cylindrical steps of decreasing diameter enabling said tool to be utilized with closures of different size.

3. The tool according to claim 2 further comprising fluting formed on the circumferential walls of each of said cylindrical step providing high friction peripherial engagement with said closure.

4. The tool according to claim 1 wherein said recess is formed with an overall high friction profile.

5. The tool according to claim 1 further comprising a soft silicon rubber insert in said recess providing said high friction profiled surface.

6. The tool according to claim 1 wherein said high friction profiled surface comprises a plurality of suction cup type devices integrally formed with said tool and extending from said surface.

7. The tool according to claim 1 further comprising a friction enhancing profile on said upper surface.

8. The tool according to claim 7 wherein said profile includes a series of annular ribs.

9. A method of removing a child resistant cap from a medication container without requiring digital gripping of a removal tool, said method comprising:

providing a medication container having a child resistant cap thereon requiring downward and rotational force to effect removal;

providing a tool formed of resilient material defining an upper smooth surface of transition and a lower planar surface with a recess adapted to recieve a cap therein, at least an inner end wall of said recess having a high friction profile;

applying said tool to said container with said cap being recieved in said recess; and applying to said upper surface palm pressure only without the requirement for finger gripping action or finger pressure to impart a downward and rotational force whereby said child resistant cap is released and removed from said container with said tool.

* * * * *